United States Patent [19]

Bergthold

[11] Patent Number: 4,614,068

[45] Date of Patent: Sep. 30, 1986

[54] EXTRUDED DOOR FRAME ASSEMBLY

[76] Inventor: Jerome M. Bergthold, 3611 Jersey Ridge Rd., Davenport, Iowa 52807

[21] Appl. No.: 653,611

[22] Filed: Sep. 24, 1984

[51] Int. Cl.[4] ..... E06B 1/04; E04C 3/30

[52] U.S. Cl. ..... 52/211; 52/214; 52/730

[58] Field of Search ..... 52/204, 208, 211, 213, 52/730, 732, 214, 215, 656; 49/504

[56] References Cited

U.S. PATENT DOCUMENTS

| | | | |
|---|---|---|---|
| 2,574,350 | 11/1951 | Peelle | 52/213 |
| 2,990,040 | 6/1961 | Stevenson | 52/215 |
| 3,274,735 | 9/1966 | Stackhouse | 52/204 |
| 3,287,856 | 11/1966 | Passovoy | 49/504 |
| 3,609,928 | 10/1971 | Mock | 52/214 |

FOREIGN PATENT DOCUMENTS

| | | | |
|---|---|---|---|
| 1167975 | 10/1969 | United Kingdom | 52/213 |

*Primary Examiner*—William F. Pate, III
*Assistant Examiner*—John Malcolm White
*Attorney, Agent, or Firm*—Ernest Kettelson

[57] ABSTRACT

An extruded door frame assembly comprising a pair of upright metal studs secured to the wall along opposite sides of the opening for the door a pair of extruded upright metal frame members or stiles secured to the metal studs, and an extruded metal cross-piece or lintel connected across the top of the door opening between the upright members or stiles. The metal studs include a laterally projecting flange which extends longitudinally for the length of the stud along a first side thereof. The extruded stiles include a longitudinal slot formed along the inner face of a corresponding first side wall, opening to receive the longitudinal flange of the respective stud to which the stiles are to be connected. An inner face portion adjacent the opposite second side wall of each stile includes a cam surface terminating at a longitudinal recess to receive therein a correspondingly shaped longitudinal projection along the opposite second side of each metal stud. The stile is pressed against the stud whereby its longitudinal projection slides along the cam surface of the stile, forcing the inner face portion to spread apart slightly until the longitudinal stud projection snaps into the longitudinal recess of the stile thereby securing the stile to the stud. The cross-piece includes corresponding slots, with metal clips to connect to the stiles. The stud flange on the hinge side is flush with the end wall. The one on the strike side is stepped for space to mount the strike box.

14 Claims, 12 Drawing Figures

EXTRUDED DOOR FRAME ASSEMBLY

BACKGROUND OF THE INVENTION

This invention relates to the field of metal door frame assemblies for mounting in door openings of walls which have a hollow space between spaced apart panels, sheets or other types of wall construction. They are commonly used for office partitions and inner office construction, to meet design needs of a particular tenant, which may change and usually does when one lease expires and a new tenant occupies the premises. For these and other reasons, the frame assemblies should be easy to assemble, require a minimum of labor expense, and have standardized component parts.

Examples of prior art door frame assemblies of this type include that disclosed in U.S. Pat. No. 4,308,692 wherein the upright members interengage with the top and bottom cross pieces to complete a relatively rigid rectangular frame. The U.S. Pat. No. 4,223,494 discloses a vinyl jamb which fits over a metal backing member, which in turn is fastened to the stud member. In U.S. Pat. No. 3,783,559, a door frame assembly is disclosed having web portions for securing hinge plates and striker plates. The U.S. Pat. No. 3,769,773 shows a metal door frame in which the cross-pieces have recesses for corresponding hooks in the upright members to seal. The U.S. Pat. No. 3,721,055 discloses a drywall door frame having slots in the upper ends of the jamb members to receive corresponding tongues of the cross-pieces. U.S. Pat. No. 3,469,350 discloses a door frame assembly in which the top cross-piece connects to the uprights by tabs inserted in corresponding slots. If also show a longtidunal door stop member which snaps in place on the upright jamb member. U.S. Pat. No. 3,385,004 discloses a door frame assembly having upwardly projecting tongues on the jambs and corresponding slots in each end of the top cross piece to connect it to the upright jamb membmers. It also includes Z-shaped stiffening members to stiffen the upright frame members. U.S. Pat. No. 3,320,705 discloses a fastening clip having cam surfaces which is nailed to the framing stud, and a metal frame member then pushed in place with its side walls being spread apart by the cam surfaces until they finally seat behind the fastening clip. U.S. Pat. No. 3,274,735 shows a facia strip snapped in place on a channel member as part of a door frame assembly. U.S. Pat. No. 3,130,455 discloses a plastic door frame having resilient side walls that spread apart and seat behind an anchoring strip nailed to the framing stud. U.S. Pat. No. 1,837,747, discloses an early type of metal door frame designed for use with plaster walls and having plaster terminals which are not connected, to help absorb the shock of door closures and prevent the shock waves from being transmitted to the plaster wall.

Each of the foregoing examples of prior art door frame assemblies disclose certain improvements and advances in this field. The present invention disclosed herein provides additional improvements and advances, in that the door frame assembly in accordance with the present invention can be secured to the framing studs by merely seating a projecting flange on one side of the stud in a groove on one side of the metal frame member, and pressing the other side of the metal frame member along a cammed surface until a groove on that side snaps in place over a projecting rib on the corresponding side of the stud. The studs and frame members have corresponding continuous ribs and grooves that mate with each other formed by the extrusion process. No tools are needed to mount the frame members in accordance with this invention to the corresponding framing studs.

SUMMARY OF THE INVENTION

It is an object of the invention to provide a door frame assembly comprising framing studs and frame members mountable thereon, wherein the studs and frame members include cooperative extruded ribs and grooves to mount the frame member to the studs.

It is an object of the invention to provide a door frame assembly comprising a pair of upright stud members, a pair of metal jamb members mountable on said stud members, and a metal top cross-piece connected between said jamb members, the jamb members and cross-pieces being mountable to complete said door frame assembly by pressing said jamb members against said stud members whereby they snap in place.

DESCRIPTION OF PREFERRED EMBODIMENT

Figure 1:
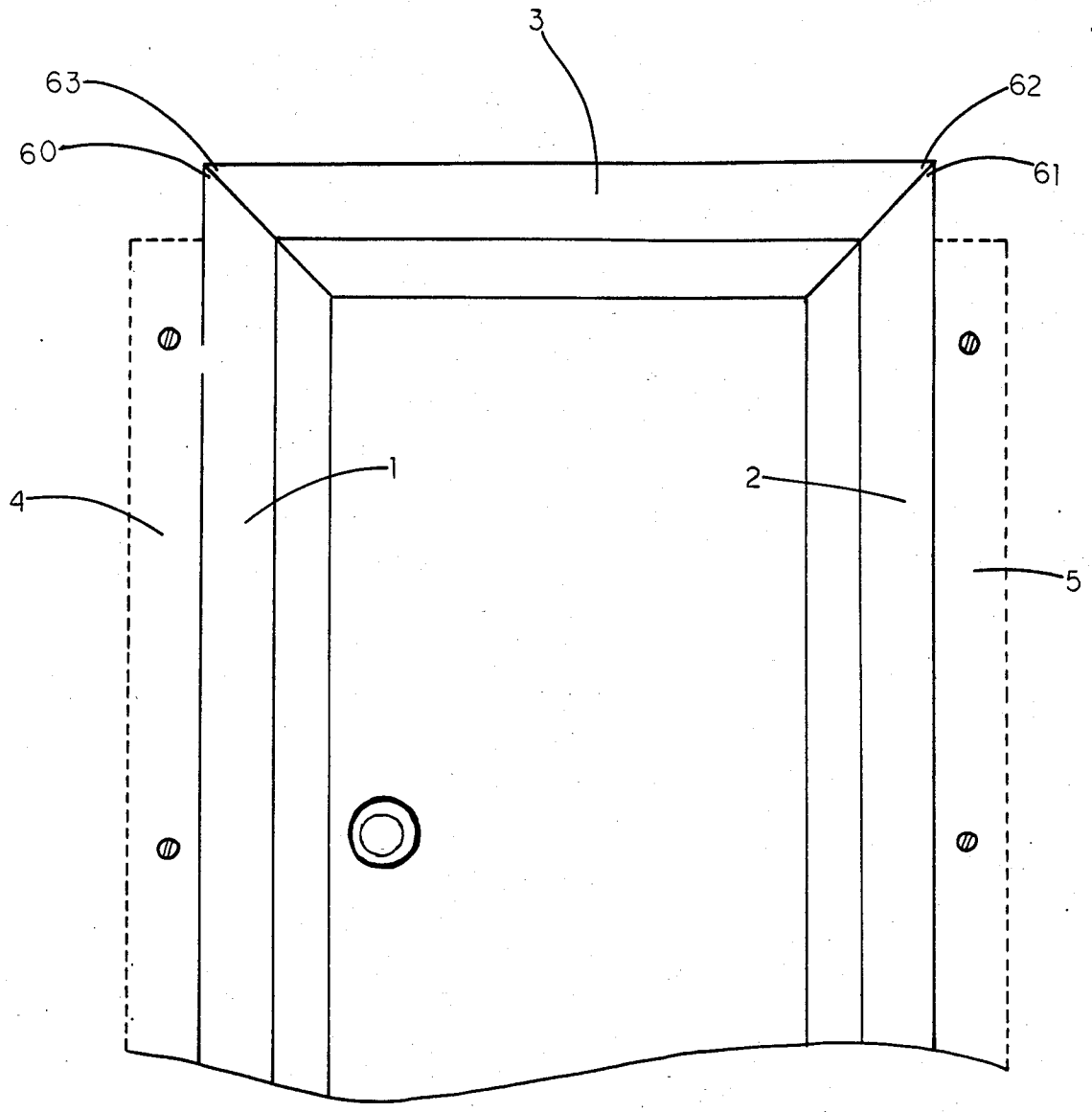
FIG. 1 is an elevation view of a door frame assembly in accordance with this invention, showing the door in place and showing the metal stud in phantom by broken lines secured between spaced apart wall panels.
Figure 2:
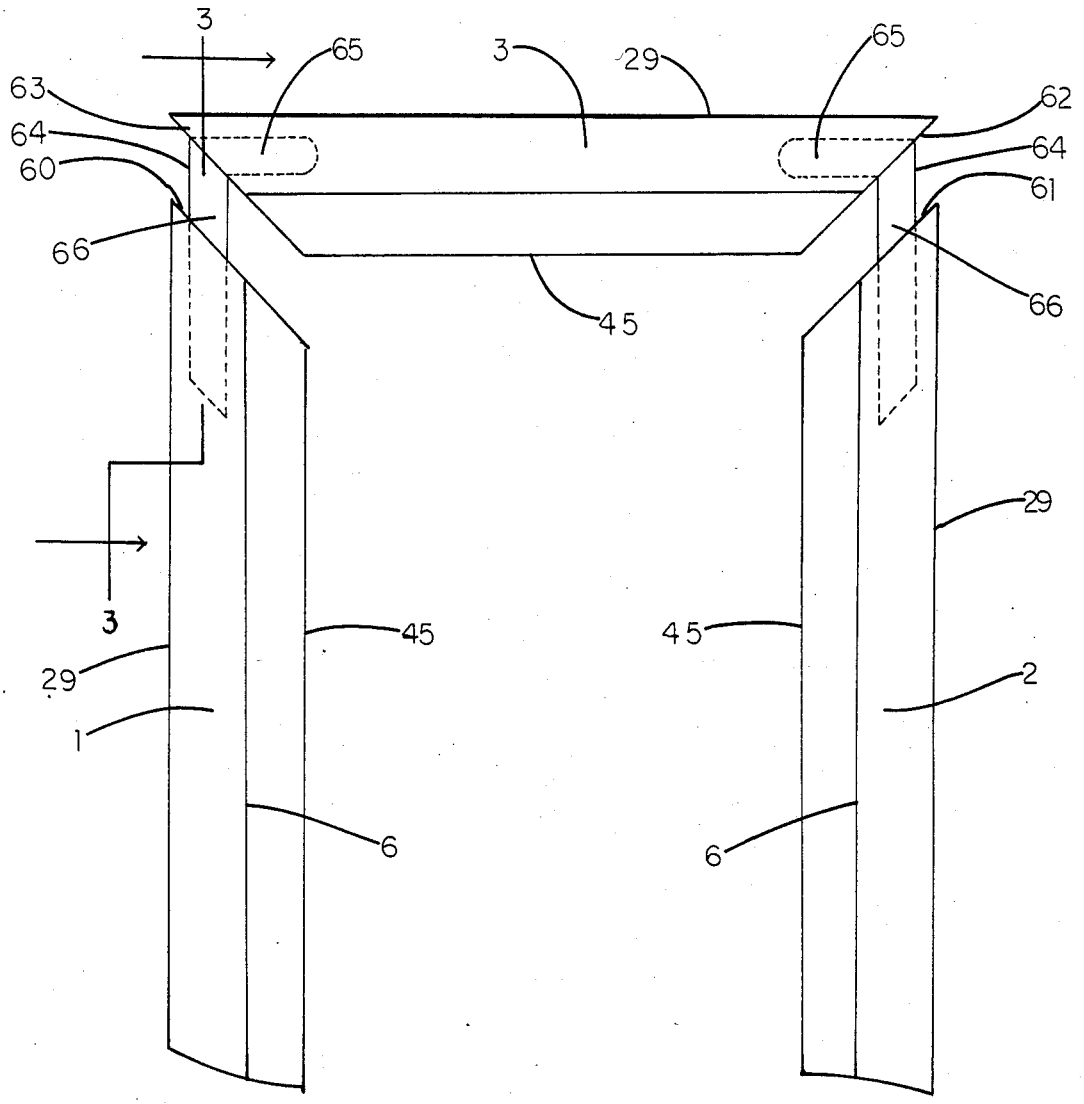
FIG. 2 is an exploded elevation view of the door frame assembly showing the lintel or top cross-piece spaced apart from the upright members and positioned for connection thereto, with connecting clips shown partially in phantom by broken lines.
Figure 3:
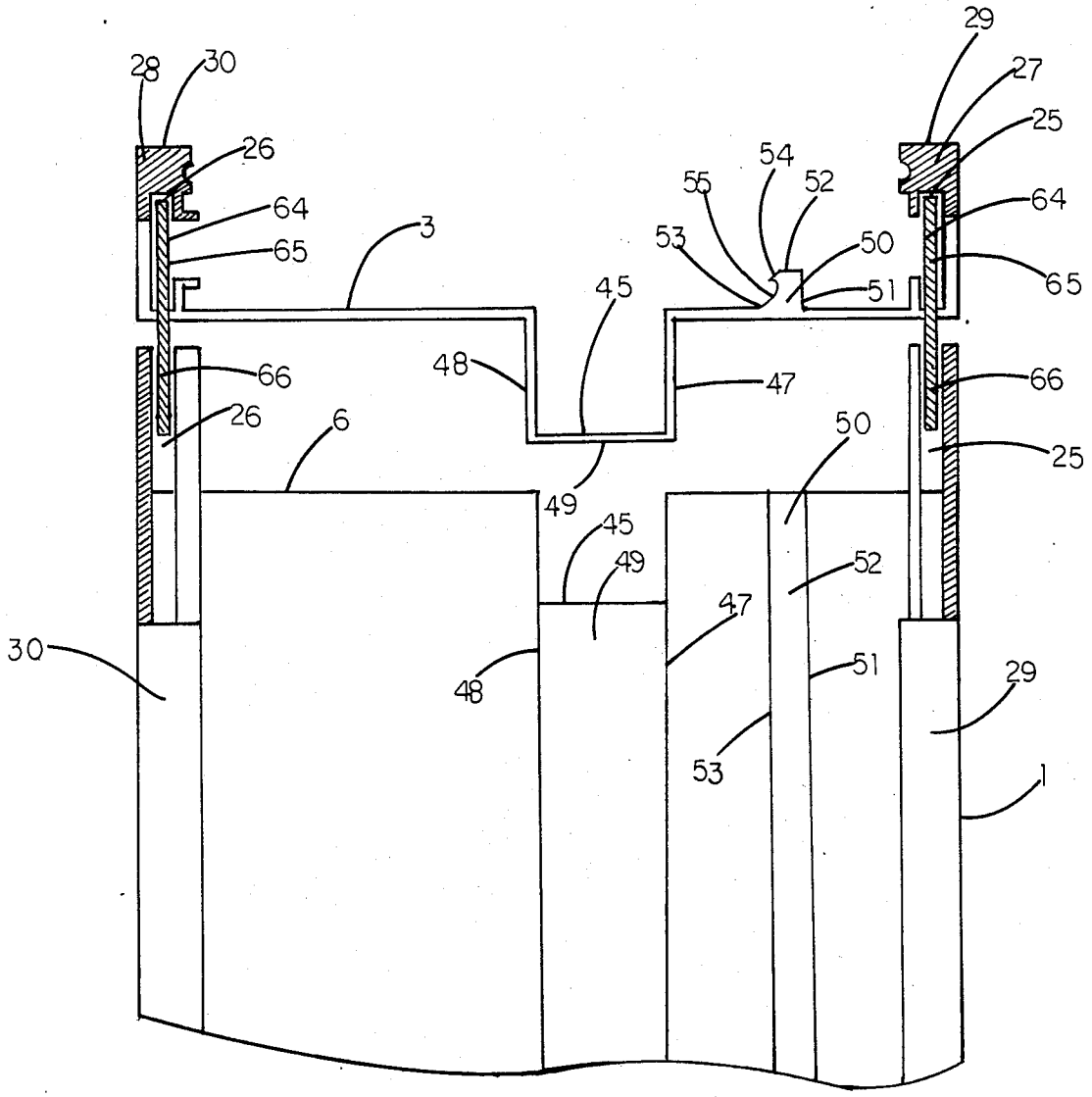
FIG. 3 is a partial section view taken on line 3—3 of FIG. 2.
Figure 4:
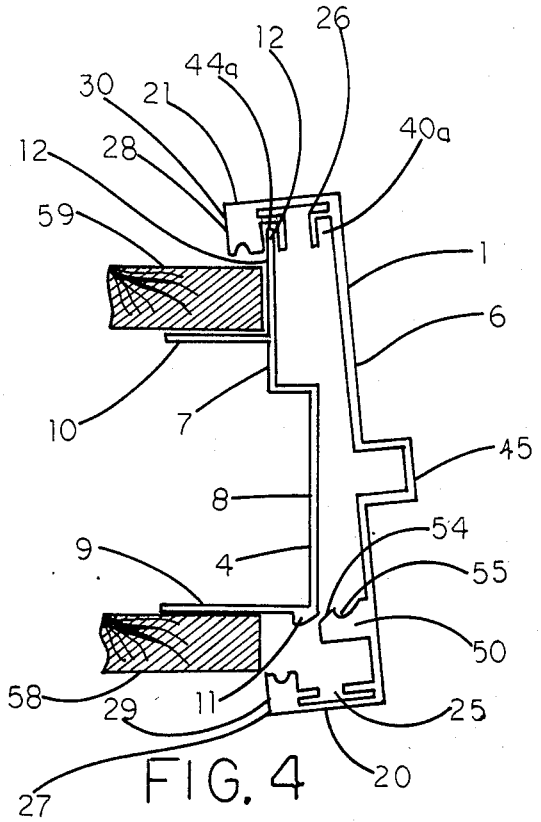
FIG. 4 is a top plan view of a metal stud for use on the strike plate side of the door frame mounted between spaced apart wall panels, and showing an upright member in accordance with this invention in position to be snapped in place on the strike plate side metal stud.
Figure 5:
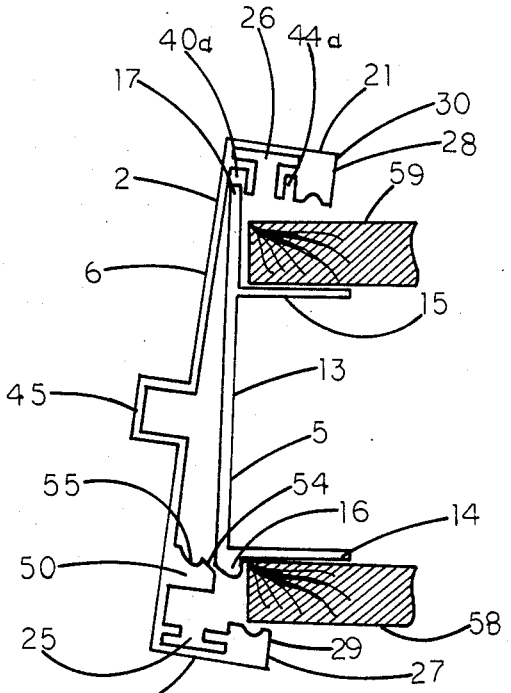
FIG. 5 is a top plan view of a metal stud for use on the hinge plate side of the door frame mounted between spaced apart wall panels, and showing an upright member in accordance with this invention in position to be snapped in place on the hinge plate side metal stud.
Figure 8:
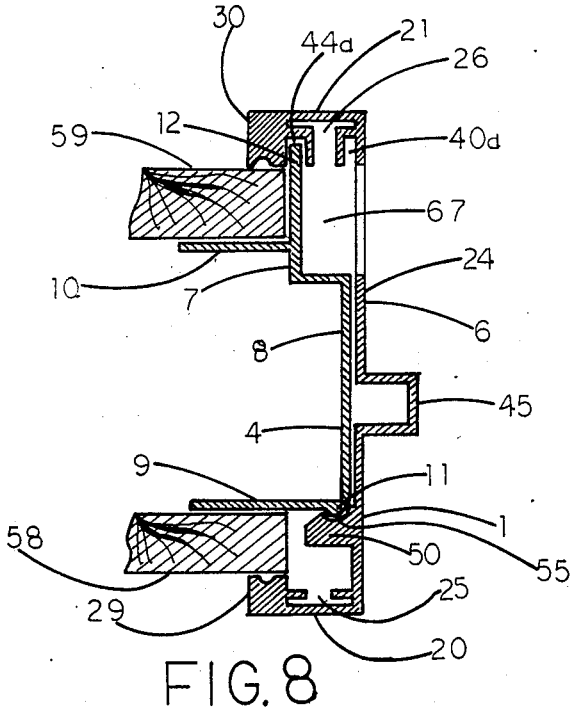
FIG. 8 is a section view taken on line 8—8 of FIG. 6.
Figure 9:
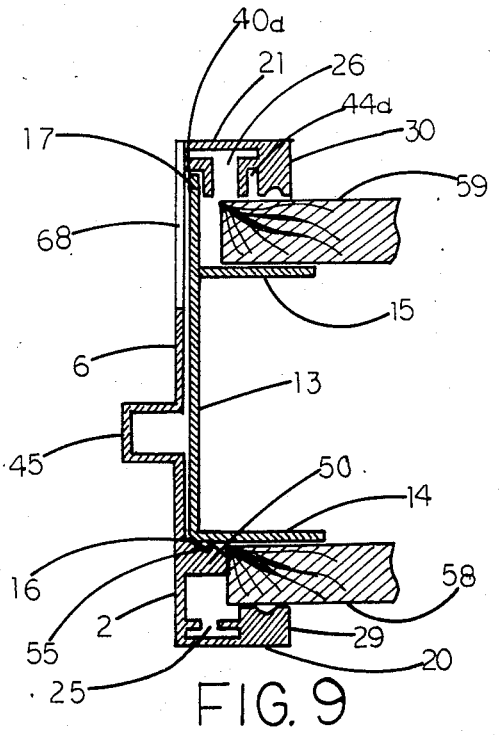
FIG. 9 is a section view taken on line 9—9 of FIG. 7.
Figure 6:
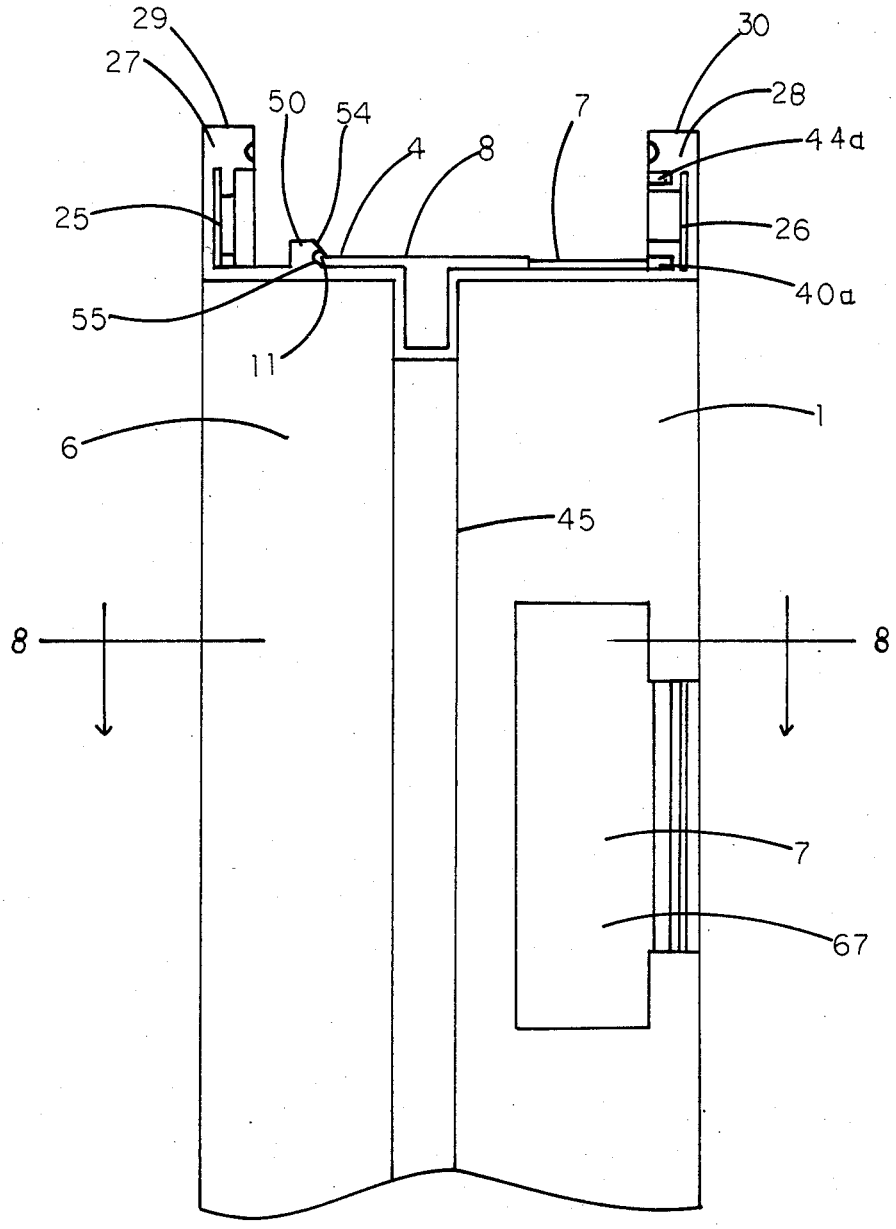
FIG. 6 is an elevation view of an upright member of a door frame assembly in accordance with this invention mounted in place on a strike plate side metal stud.
Figure 7:
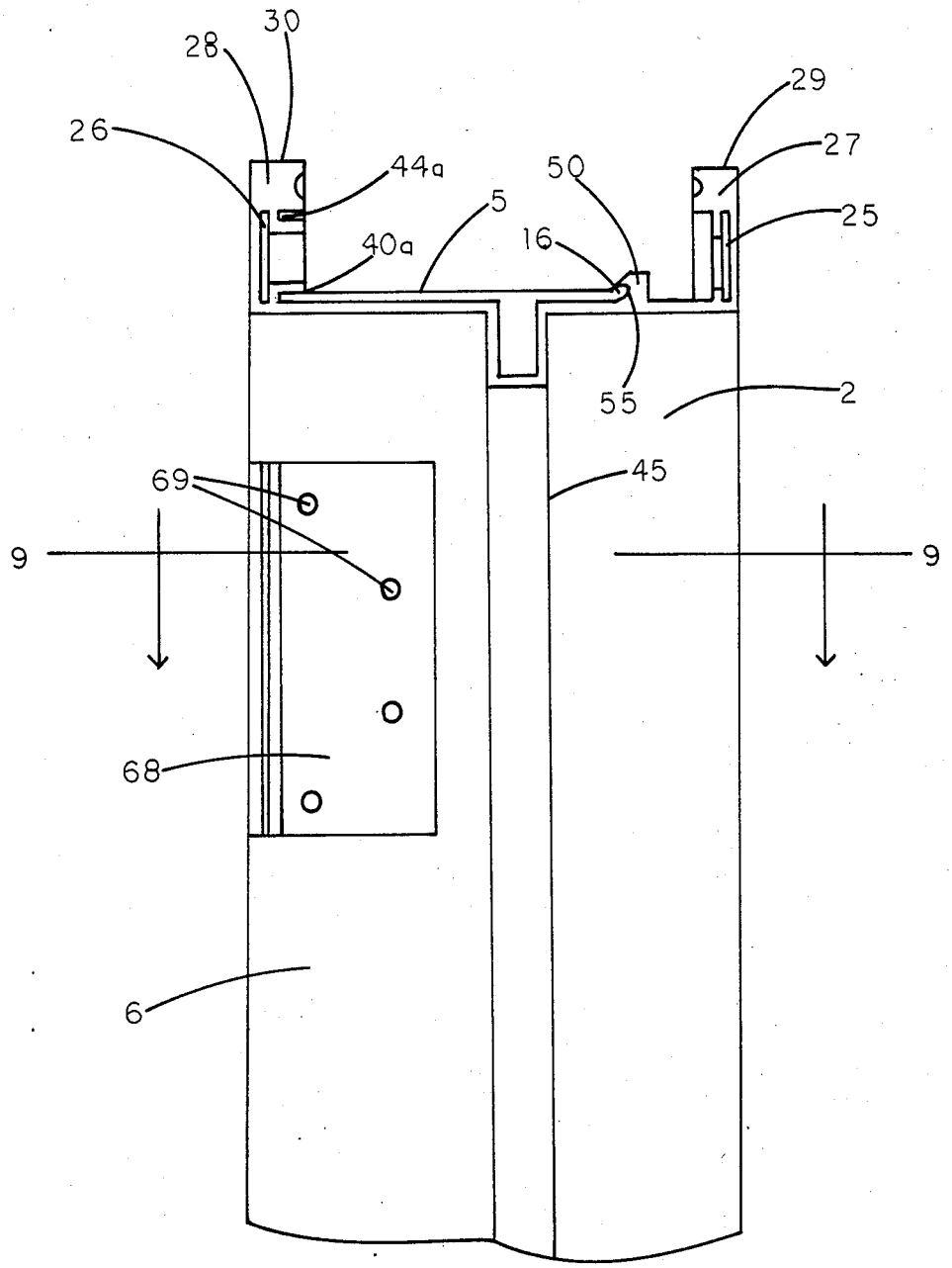
FIG. 7 is an elevation view of an upright member of a door frame assembly in accordance with this invention mounted in place on a hinge plate side metal stud.
Figure 10:
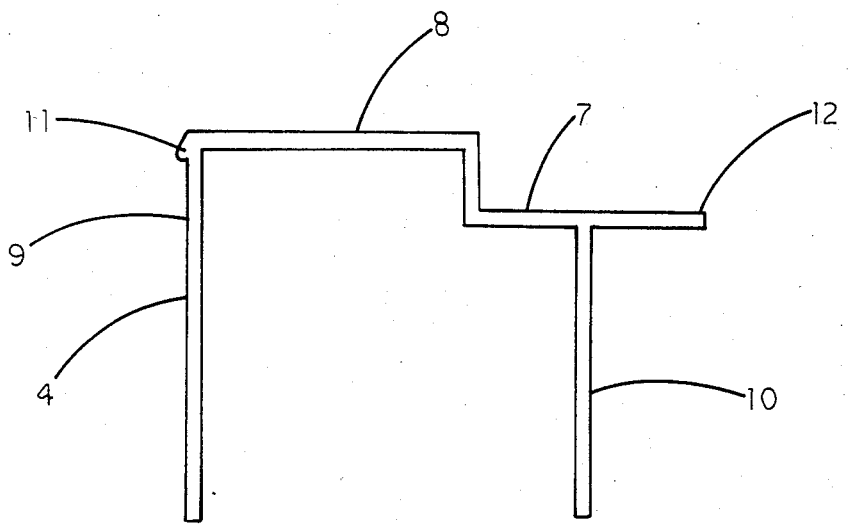
FIG. 10 is a top plan view of a metal stud in accordance with this invention for use on the strike plate side of a door frame, showing its cross-sectional configuration.
Figure 11:
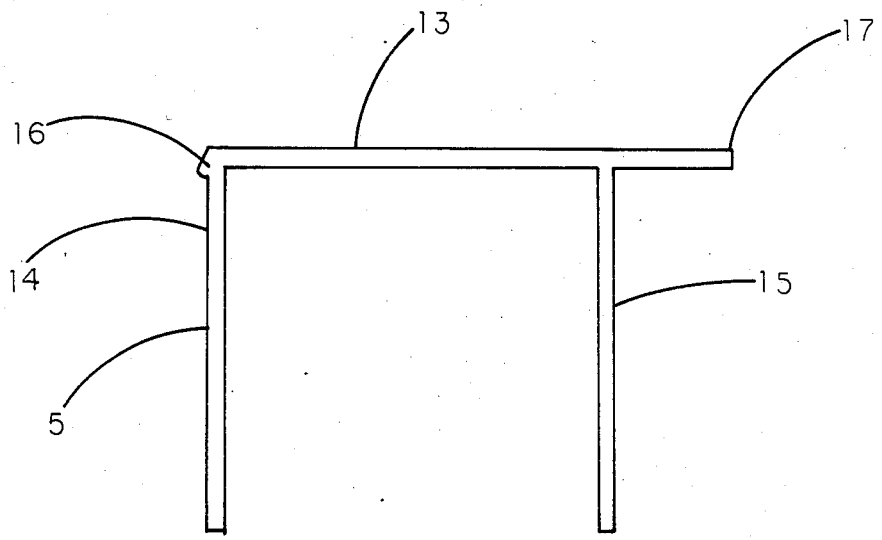
FIG. 11 is a top plan view of a metal stud in accordance with this invention for use on the hinge plate side of a door frame, showing its cross-sectional congfiguration.
Figure 12:
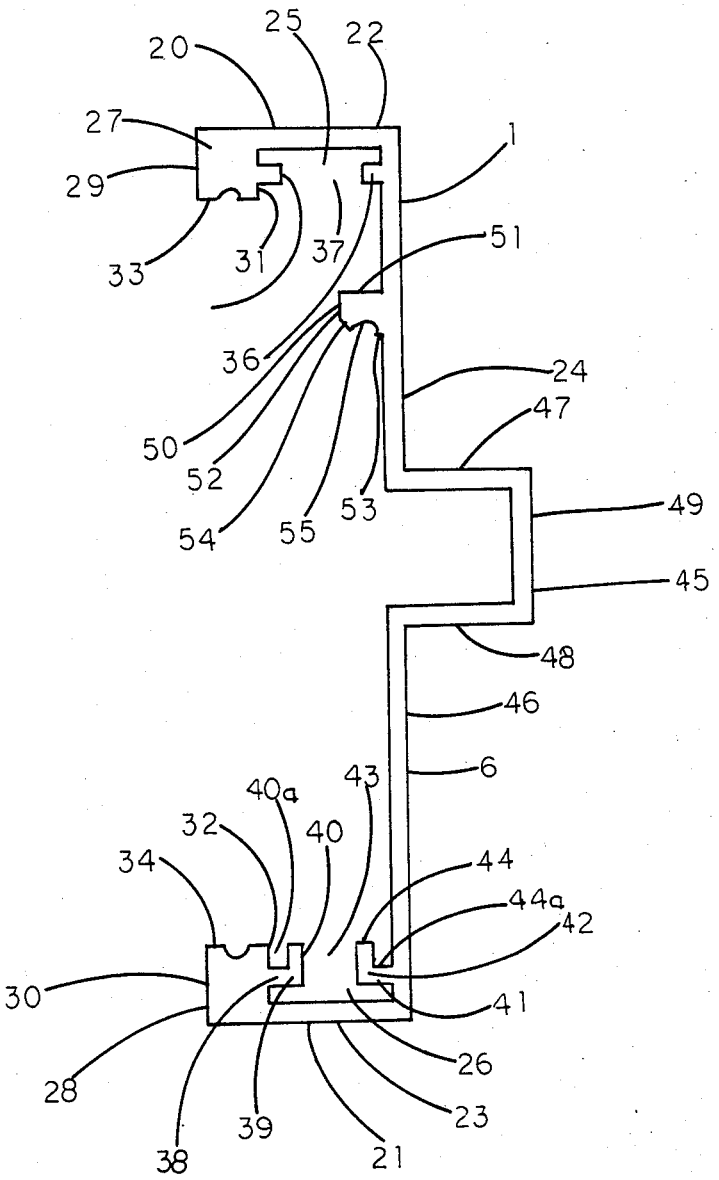
FIG. 12 is a top plan view of a metal upright member in accordance with this invention, showing its cross-sectional configuration which is the same for both the strike plate side and hinge plate side of the frame assembly.

A door frame assembly in accordance with this invention includes a pair of upright members or stiles 1 and 2, a top cross-piece or lintel 3, a metal stud 4 for the strike plate side of the door frame and a slightly different metal stud 5 for the hinge plate side of the door frame.

The upright members 1 and 2 are of a metal such as aluminum which may be extruded, as is the cross-piece 3 and the metal studs 4 and 5. The cross-sectional configuration of the upright members 1 and 2 is identical. However, the openings in the end wall 6 for mounting a strike box when used on the strike plate side and for mounting the hinges when used on the hinge plate side are different as described in more detail herein below.

The metal stud 4 for the strike plate side is an elongated extrusion of generally U-shaped configuration, but having an inwardly stepped portion 7 along the end wall 8 between the side walls 9 and 10. The inwardly stepped portion 7 provides space for mounting a strike box (not shown) when upright member 1 is mounted on the strike side metal stud 4, the end wall 6 of upright member 1 being spaced apart from the inwardly stepped portion 7 of the stud 4 a sufficient distance to receive a strike box therebetween. The end wall 8 of metal stud 4 includes an elongated projecting rib 11 projecting outwardly in one direction from the junction point of end wall 8 and side wall 9. The opposite end of end wall 8, and of the inwardly stepped portion 7 thereof, includes a thin wall flange 12 extending outwardly in the opposite direction from the junction point of side wall 10 and the stepped portion 7 of end wall 8. The flange 12 extends outwardly in line with the stepped portion 7 of end wall 8, and at a substantially right angle to side wall 10. Side walls 9 and 10 extend at substantially right angles from opposite end regions of the end wall 8.

The metal stud 5 for the hinge side of the door frame is of generally U-shaped configuration, comprising an end wall 13 and side walls 14 and 15 extending at substantially right angles to end wall 13 from opposite side edges thereof. A projecting rib 16 extends outwardly in one direction from the junction point of end wall 13 and side wall 14. The opposite end of end wall 13 includes a thin wall flange 17 extending outwardly in the opposite direction from the junction point of end wall 13 and side wall 15. The flange 17 extends outwardly in line with end wall 13 and, and at a substantially right angle to side wall 15.

The projecting rib 11 and projecting flange 12 of metal stud 4, and the projecting rib 16 and projecting flange 17 of metal stud 5, extend longitudinally the entire length of such metal studs and are formed integrally with the other parts of such metal studs by the extrusion process.

The upright members 1 and 2 are also formed by the extrusion process using the same die. They both have identical cross-sectional configuration, and include a pair of side wall members 20 and 21 whose outer walls 22 and 23 extend at substantially right angles from opposite ends of a front end wall 24. A longitudinal slot 25 extends for the full length of the upright member along side wall member 20, spaced inwardly a slight distance from its outer wall 22 and extending parallel thereto. A similar longitudinal slot 26 extends for the full length of the upright member along side wall member 21, spaced inwardly a slight distance from its outer wall 23 and extending parallel thereto.

Side wall members 20 and 21 include respective inturned body portions 27 and 28 turned in toward each other at the ends thereof opposite their connection to front end wall 24, the outer walls 29 and 30 respectively of inturned body portions 27 and 28 extending at substantially right angles to the outer walls 22 and 23 of the side wall members 20 and 21. The inturned body portions 27 and 28 include respective inner walls 31 and 32 which extend parallel to their respective outer walls 29 and 30, and respective inward facing end walls 33 and 34 which extend between said inner and outer walls.

The inturned body portion 27 of side wall member 20 includes a lug 35 projecting from the face of inner wall 31 a short distance toward the front end wall 24, parallel to outer wall 22 and spaced apart inwardly therefrom to border a portion of the innermost side of longitudinal slot 25. A corresponding lug 36 projects from the inner surface of front end wall 24 a short distance toward lug 35, parallel to outer wall 22 and spaced apart inwardly therefrom to border a portion of the innermost side of longitudinal slot 25. Lugs 35 and 36 are coplanar and spaced apart across a side wall opening 37 to longitudinal slot 25, and they extend longitudinally for the entire length of the upright member 1 or 2.

The inturned body portion 28 of side wall member 21 includes a lug 38 of L-shaped cross-section projecting from the face of inner wall 32 a short distance toward the front end wall 24, one leg 39 of lug 38 being parallel to outer wall 23 and spaced apart inwardly therefrom to border a portion of the innermost side of longitudinal slot 26. The other leg 40 of L-shaped lug 38 projects from leg 39 at a right angle in the direction toward the opposite side wall member 20. A corresponding L-shaped lug 41 projects from the inner surface of front end wall 24 a short distance toward L-shaped lug 38, one leg 42 of lug 41 being parallel to outer wall 23 and spaced apart inwardly therefrom to border a portion of the innermost side of longitudinal slot 26. The legs 39 of lug 38 and 42 of lug 41 are coplanar and spaced apart across a side wall opening 43 to longitudinal slot 26. The other leg 41 of L-shaped lug 41 projects from leg 42 at a right angle in the direction toward the opposite side wall member 20. Leg 44 of lug 41 is also parallel to leg 40 of lug 38, and spaced apart therefrom across the side-wall opening to longitudinal slot 26. The L-shaped lugs 38 and 41 extend longitudinally for the entire length of the upright member 1 or 2. Leg 44 of L-shaped lug 41 is spaced apart from the inner surface of the front end wall 24 of the upright member to form longitudinal slot **44*a*. Leg 40 of L-shaped lug 38 is spaced apart from the inner wall 32 of inturned body portion 28 to form longitudinal slot 40*a***.

The front end wall 24 includes an integrally formed door stop portion 45 projecting outwardly from the outer surface of front end wall 24 in the opposite direction from that in which the pair of side wall members 20 and 21 extend, at an intermediate location thereof inwardly from each opposite end. The exact location of door stop portion 45 is a matter of choice depending in part on the thickness of the door to be used, the exact location of the hinge plates and of the strike box and the like. In the embodiment of the invention specifically disclosed herein, the door stop portion 45 is located almost midway from the side edges of front end wall 24, but slightly closer to the side edge from which side wall member 20 extends. Openings for the hinge plates are made in the upright members through that portion 46 which extends between the door stop portion 45 and the side edge from which side wall member 21 extends. The door stop portion 45 includes a pair of door stop side walls 47 and 48 and a connecting end wall 49. The door stop side walls 47 and 48 extend at right angles to the outer surface of front end wall 24.

A snap-in locking lug 50 is provided which extends from the inner surface of front end wall 24 of the upright member in a direction opposite from that in which the door stop portion 45 extends, and at a location between that of the door stop portion 45 and the side edge from which side wall member 20 extends. The snap-in locking lug 50 is integrally formed with the other portions of the upright member by the extrusion process and extends longitudinally for the entire length of the upright member. The snap-in locking lug 50 includes a first side wall 51 extending at a right angle to the inner surface of the front end wall 24 facing toward the side wall member 20, an end wall 52 extends at a right angle to first side wall 51 in a direction toward the opposite side wall member 21, and a second side wall 53 extending between end wall 52 of locking lug 50 and the inner surface of front end wall 24 of the upright member.

The second side wall 53 of locking lug 50 includes a cam surface 54 extending at an incline from end wall 52 of the locking lug 50, diverging from the opposite first side wall 51 as it extends toward the inner surface of front end wall 24 of the upright member, slanting in the direction toward the opposite side wall member 21 as it extends toward the inner surface of front end wall 24, the cam surface 54 terminating at lug recess 55 formed in the locking lug 50 having a cross-sectional configuration corresponding to that of projecting rib 11 of metal stud 4 and of projecting rib 16 of metal stud 5, one or the other of which is to be received in lug recess 55 when the upright member 1 or 2 is mounted in place on metal stud 4 or metal stud 5, depending on whether the upright member is used on the strike plate side of the door frame or the hinge plate side.

The exact location of snap-in locking lug 50 on the inner surface of the front end wall 24 of the upright member is determined by the distance between projecting rib 11 and the free end of projecting flange 12 of metal stud 4, or between projecting rib 16 and the free end of projecting flange 17. Locking lug 50 is located so its lug recess 55 is spaced apart from the slot 40*a* or slot 44*a* adjacent side wall member 21 the same distance as the projecting ribs 11 and 16 are from the free ends of their corresponding projecting flanges 12 and 17 respectively.

The upright member 1 is mounted on metal stud 4 by positioning slot 44*a* to receive the free end of projecting flange 12 of metal stud 4, pressing the upright member 1 inward toward metal stud 4 until the cam surface 54 of locking lug 50 of upright member 1 engages the projecting rib 11 of the metal stud 4, then continuing to press inwardly with the cam surface 54 forcing lug 50 to spread apart slightly from the side wall member 21 as the upright member 1 is pressed against the metal stud 4 until lug recess 55 of the upright member comes into registration with projecting rib 11 of the metal stud 4. At such time, the locking lug 50 snaps back to its original position seating projecting rib 11 of the metal stud 4 in the lug recess 55 of the snap-in locking lug 50.

The upright member 2 is mounted on metal stud 5 by positioning slot 40*a* to receive the free end of projecting flange 17 of metal stud 5, pressing the upright member 2 inward toward the metal stud 5 until the cam surface 54 of locking lug 50 of the upright member 2 engages the projecting rib 16 of the metal stud 5, then continuing to press inwardly with the cam surface 54 forcing locking lug 50 to spread apart slightly from side wall member 21 as the upright member 2 is pressed against the metal stud 5 until lug recess 55 of the upright member 2 comes into registration with projecting rib 16 of the metal stud 5. At such time, the locking lug 50 snaps back to its original position seating projecting rib 16 of the metal stud 5 in the lug recess 55 of the snap-in locking lug 50.

The metal studs 4 and 5 are mounted between wall panels 58 and 59 on opposite sides of an opening provided for the door frame assembly in such a way that the projecting flange 12 of stud 4 is directly opposite from projecting flange 17 of stud 5, and projecting rib 11 of stud 4 is directly opposite from projecting rib 16 of stud 5. In other words the projecting flanges 12 and 17 face toward the same side of the wall, namely wall panel 59 as shown in the drawing, and the projecting ribs 11 and 16 face toward the same opposite side of the wall, namely wall panel 58 as shown in the drawing.

The upright members 1 and 2 have the same cross-sectional configuration but differ in the peripheral configuration of their respective upper ends 60 and 61. The upright member 1 to be mounted on metal stud 4 to serve as the upright member on the strike side of the frame, is cut away at its upper end 60 on a diagonal line slanting in one first direction at a forty-five degree angle inwardly of the upright member from the outer walls 29 and 30 of inturned body portions 27 of side wall members 20 and 28 of side wall member 21 toward the door stop portion 45 of the front end wall 24.

The upright member 2 to be mounted on metal stud 5 to serve as the upright member on the hinge side of the frame is cut away at its upper end 61 on a diagonal line slanting in the opposite second direction at a forty-five degree angle inwardly of the upright member from the outer walls 29 and 30 of inturned body portions 27 and 28 toward the door stop portion 45 of the front end wall 24.

The top cross-piece or lintel 3 is also of the same cross-sectional configuration as upright members 1 and 2 but differs in that both ends of the cross-piece are cut away on a diagonal line at a forty-five degree angle inwardly of the cross-piece from the outer walls 29 and 30 of inturned body portions 27 and 28 toward the door stop portion 45 of the front end wall 24. One end 62 is cut away to slant in the said first direction the same as the upper end 60 of upright member 1. The other end 63 is cut away to slant in the said second direction, oppositely of the first, the same as the upper end 61 of upright member 2.

When assembling the frame pieces to make the door frame, the angled end 62 of cross-piece 3 which slants in the said first direction is placed adjacent the upper end 61 of upright member 2 which slants in the said second direction, and the other angled end 63 of cross-piece 3 which slants in the said second direction is placed adjacent the upper end 60 of upright member 1 which slants in the said first direction.

The L-shaped metal connecting tabs 64 have one leg 65 inserted in corresponding slots 25 and 26 at each end 62 and 63 of the cross-piece 3, with the other leg 66 of L-shaped connecting tabs 64 extending downwardly to seat in corresponding slots 25 and 26 of upright members 1 and 2. The angled upper end 60 of upright member 1 is then bought into abutting relationship with angled end 63 of cross-piece 3, and the angled upper end 61 of upright member 2 is then brought into abutting relationship with angled end 62 of cross-piece 3, thereby forming mitered joints at each end of the top cross-piece 3 with the upright member 1 and 2.

Upright member 1 also differs from upright member 2 in that upright member 1 has an opening 67 formed in that portion of its front end wall 24 adjacent side wall member 21 of generally rectangular peripheral configuration to correspond in size and shape with a strike box to be mounted therein. The upright member 2 has two or more openings 68 formed in that portion of its front end wall 24 adjacent side wall member 21, also of generally rectangular configuration to correspond in size and shape with hinge plates to be bolted or screwed in place by bolts or screws received in the threaded taps 69 formed in the end wall 13 of metal stud 5.

The metal studs 4 and 5 are secured between the wall panels 58 and 59 by screws or other appropriate fasteners extending through wall panels 58 and 59 into the side walls of the studs.

I claim:

1. A door frame assembly, comprising a first upright member for one side of a door opening, a second upright member for the opposite side of a door opening, a top cross-piece extending between said first and second upright members at the upper ends thereof, wherein said first upright member comprises an elongframe member, including a front end wall having a first side edge and a second side edge, an outer facing surface and an inner facing surface, a first side wall member extending in one direction from the inner surface of said front end wall at said first side edge, a second side wall member extending in said one direction from the inner surface of said front end wall at said second side edge, first slot means adjacent said first side edge on said inner facing surface side of said front end wall to receive first projecting means of a mounting stud therein, said first slot means opening in the direction toward said second side edge, said first slot means including a spaced apart side wall substantially parallel to said front end wall which terminates at one end at the said opening of said first slot means in the direction toward said second side edge and at the other end at an end wall extending therefrom substantially normal thereto in the direction toward said front end wall and terminating thereat, cam surface means to slidingly engage second projecting means of said mounting stud, said cam surface means being on said inner facing surface side of said front end wall spaced apart from said first slot means in the direction toward said second side edge, said cam surface means extending in a direction toward said inner facing surface of said first end wall and terminating at a locking recess positioned between said cam surface means and said inner facing surface side of said front end wall to receive said second projecting means of said mounting stud therein, said cam surface means facing toward said first side wall member, including said mounting stud and said first and second projecting means thereof, said first projecting means being elongated relative to said second projecting means, said first projecting means of said mounting stud for said first upright member is a projecting flange projecting outwardly a substantial distance to one side of said mounting stud, said first slot means includes a first slot formed adjacent said first side edge to receive a portion of said projecting flange therein, said projecting flange of said mounting stud being substantially parallel to said front end wall of said front upright member when received in said first slot, said second projecting means of said mounting stud is a projecting rib projecting a relatively short distance to the opposite side of said mounting stud, said cam surface means includes a snap-in locking lug extending from said inner surface of said front end wall, a first side wall of said snap-in locking lug facing said first slot formed adjacent said first side edge of said front end wall, a second side wall of said snap-in locking lug being planar and facing said second side edge of said front end wall, said planar second side wall of said locking lug being spaced apart from said second side wall member in the direction toward said first side wall member, a diagonally extending cam surface on said first side wall of said snap-in locking lug diverging from said second side wall therefof as it extends toward said inner surface of said front end wall, said locking recess being formed in said snapin locking lug and opening toward said first slot formed adjacent said first side edge, said diagonally extending cam surface terminating at said locking recess.

2. A door frame assembly as set forth in claim 1, wherein said first upright member includes an upper end and a lower end, a second slot between said first slot and said first side edge, said second slot opening to said upper end of said first upright member, a third slot adjacent said second side edge opening to said upper end of said first upright member, said second and third slots of said first upright member being adapted to receive connecting tabs therein to connect a first end of said top cross-piece to said first upright member in abutting relationship.

3. A door frame assembly as set forth in claim 2, wherein said second upright member comprises an elongated frame member, including a front end wall having a first side edge and a second side edge, an outer facing surface and an inner facing surface, a first side wall member extending in one direction from the inner surface of said front end wall at said first side edge, a second side wall member extending in said one direction from the inner surface of said front end wall at said second side edge, first slot means adjacent said first side edge on said inner facing surface side of said front end wall to receive first projecting means of a mounting stud therein, said first slot means opening in the direction toward said second side edge, said first slot means including a spaced apart side wall substantially parallel to said front end wall which terminates at one end at the said opening of said first slot means in the direction toward said second side edge and at the other end at an end wall extending therefrom substantially normal thereto in the direction toward said front end wall and terminating thereat, cam surface means to slidingly engage second projecting means of said mounting stud, said cam surface means being on said inner facing surface side of said front end wall spaced apart from said first slot means in the direction toward said second side edge, said cam surface means extending in a direction toward said inner facing surface of said front end wall and terminating at a locking recess positioned between said cam surface means and said inner facing surface side of said front end wall to receive said second projecting means of said mounting stud therein, said cam surface means facing toward said first side wall member of said second upright member, including said mounting stud for said second upright member and said first and second projecting means of said mounting stud, said first projecting means being elongated relative to said second projecting means.

4. A door frame assembly as set forth in claim 3, wherein said first projecting means of said mounting stud for said second upright member is a projecting flange projecting outwardly a relatively substantial distance to one side of said mounting stud, said first slot means includes a first slot formed inwardly of said first side edge to receive a portion of said projecting flange therein, said projecting flange of said mounting stud being substantially parallel to said front end wall of said second upright member when received in said first slot thereof, said second projecting means of said mounting stud is a projecting rib a relatively short distance to the opposite side of said mounting stud, said cam surface means incude a snap-in locking lug extending from said inner surface of said front end wall, a first side wall of said snap-in locking lug facing said slot formed adjacent said first side edge of said front end wall of said second upright member, a second side wall of said snap-in locking lug being planar facing said second side edge of said front end wall of said second second upright member, said planar second side wall of said locking lug being spaced apart from said second side wall member of said upright member in the direction toward said first side wall member of said second upright member, a diagonally extending cam surface on said first side wall of said snap-in locking lug diverging from said second side wall thereof as it extends toward said inner surface of said front end wall of said second upright member, said locking recess being formed in said snap-in locking lug and opening toward said slot formed adjacent said first side edge of said second upright member, said diagonally extending cam surface terminating at said locking recess.

5. A door frame assembly as set forth in claim 4, wherein said second upright member includes an upper end and a lower end, a second slot between said first slot and said first side edge of said second upright member, said second slot opening to said upper end of said second upright member, a third slot adjacent said second side edge of said second upright member opening to said upper end of said second upright member, said second and third slots of said second upright member being adapted to receive connecting tabs therein to connect a second opposite end of said top cross-piece to said second upright member in abutting relationship.

6. A door frame assembly as set forth in claim 5, wherein said outer facing surface of said first upright member and said outer facing surface of said second upright member face each other in spaced apart relationship, said upper ends of said first and second upright members extend diagonally upwardly at substantially forty-five degree angles from their respective outer facing surfaces toward the free ends of their respective side wall members.

7. A door frame assembly as set forth in claim 6, wherein said top cross-piece extends between said upper ends of said first and second upright members, said top cross-piece including a front end wall corresponding to that of said first and second upright members, first and second side edges corresponding to those of said first and second upright members, said front end wall of said top cross-piece having an outer facing surface and an inner facing surface corresponding to those of said first and second upright members, first and second side wall members of said top cross-piece extending in one direction from said inner facing surface thereof, the ends of said top cross-piece being formed to extend outwardly from the respective ends thereof diagonally at substantially forty-five degree angles from the outer facing surface of said front end wall of said top cross-piece toward the free ends of said first and second side wall members thereof, connecting tab receiving slots in said first and second side wall members of said top cross-piece extending longitudinally thereof and opening to each opposite end thereof, said connecting tab receiving slots of said top cross-piece being in registration with corresponding ones of said second and third slots of said first and second upright members when said top cross-piece is in place between said upper ends of said first and second upright members, said top cross-piece and said upper ends of said first and second upright members forming mitered joints at their respective adjoining diagonal ends.

8. A door frame assembly as set forth in claim 7, including said connecting tabs, said connecting tabs including a relatively thin, planar L-shaped member, having a first tab leg for insertion into one of said second and third slots of said first and second upright members, a second tab leg at a substantially right angle to said first tab leg for insertion into a corresponding one of said connecting tab receiving slots of said top cross-piece to connect the adjoining ends of said upright members to corresponding ends of said top cross-piece.

9. A door frame assembly as set forth in claim 1, wherein said front end wall of said first upright member includes an integrally formed door stop member projecting outwardly from said outer facing surface of said front end wall at an intermediate location between said first side edge and said second side edge.

10. A door frame assembly as set forth in claim 3, wherein said front end wall of both of said first and second upright members includes an integrally formed door stop member projecting outwardly from said outer facing surface of said front end wall of each of said first and second upright members at an intermediate location between said first side edge and said second side edge of said front end wall of each of said upright members.

11. A door frame assembly, comprising a first upright member for one side of a door opening, a second upright member for the opposite side of a door opening, a top cross-piece extending between said first and second upright member at the upper ends thereof, wherein said first upright member comprises an elongated frame member, including a front end wall having a first side edge and a second side edge, an outer facing surface and an inner facing surface, a first side wall member extending in one direction from the inner surface of said front end wall at said first side edge, a second side wall member extending in said one direction from the inner surface of said front end wall at said second side edge, first slot means adjacent said first side edge on said inner facing surface side of said front end wall to receive first projecting means of a mounting stud therein, said first slot means opening in the direction toward said second side edge, cam surface means to slidingly engage second projecting means of said mounting stud, said cam surface means being on said inner facing surface side of said front end wall spaced apart from said first slot means in the direction toward said second side edge, said cam surface means extending in a direction toward said inner facing surface of said front end wall and terminating at a locking recess positioned between said cam surface means and said inner facing surface side of said front end wall to receive said second projecting means of said mounting stud therein, including said mounting stud and said first and second projecting means thereof, wherein said mounting stud for said first upright member includes a pair of spaced apart elongated stud side walls for securing said mounting stud between spaced apart wall panels, and a stud end wall extending between said stud side walls, said stud end wall including a first end wall portion extending from a first one of said stud side walls toward the second one of said stud side walls terminating at an intermediate point therebetween, a second stepped end wall portion extending from said intermediate point to said second one of said stud side walls and beyond to provide a projecting flange extending at a substantially right angle from said second one of said stud side walls, said projecting flange comprising said first projecting means of said mounting stud for said first upright member, said stepped end wall portion extending in a plane substantially parallel to said first end wall portion and spaced apart from said first end wall portion in the direction toward the free ends of said stud side walls, whereby a strike box space is provided to receive a strike box when said first upright member is mounted on said mounting stud provided therefor, including a projecting rib extending outwardly from the junction of said first end wall portion and said first one of said stud side walls, said projecting rib comprising said second projecting means of said mounting stud for said first upright member.

12. A door frame assembly as set forth in claim 7, wherein said mounting stud for said second upright member includes a pair of spaced apart elongated stud side walls for securing said mounting stud betwen spaced apart wall panels, and a stud end wall extending in a substantially straight line between said pair of stud end walls and at a substantially right angle thereto, a projecting rib extending outwardly from the junction of said stud end wall and a first one of said stud side walls, said projecting rib comprising said second projecting means of said mounting stud for said second upright member, said stud end wall extending beyond the second one of said stud side walls to provide a projecting flange extending at a substantially right angle from said second one of said stud side walls, said projecting flange comprising said first projecting means of said mounting stud for said first upright member.

13. A door frame assembly as set forth in claim 11, wherein said front end wall of said first upright member includes a strike box opening therethrough to said stepped end wall portion of said mounting stud for said first upright member for access to said strike box space.

14. A door frame assembly as set forth in claim 12, wherein said front end wall of said second upright member includes a plurality of spaced apart hinge plate openings therethrough to said stud end wall of said mounting stud for said second upright member, threaded taps in said stud end wall at said hinge plate openings to receive mounting screws to secure hinge plates and hinges to said mounting stud for said second upright member at said hinge plate openings.

* * * * *